US012765620B2

(12) United States Patent
Chakravaram

(10) Patent No.: US 12,765,620 B2
(45) Date of Patent: Oct. 20, 2026

(54) HAND GLOVES FOLD PREVENTION CLIP

(71) Applicant: Vishnu Vardhan Chakravaram, Gallatin, TN (US)

(72) Inventor: Vishnu Vardhan Chakravaram, Gallatin, TN (US)

(73) Assignee: Vishnu Vardhan Chakravaram, Gallatin, TN (US)

( * ) Notice: Subject to any disclaimer, the term of this patent is extended or adjusted under 35 U.S.C. 154(b) by 0 days.

(21) Appl. No.: 18/913,290

(22) Filed: Oct. 11, 2024

(65) Prior Publication Data

US 2026/0101944 A1 Apr. 16, 2026

(51) Int. Cl.
*A41D 19/00* (2006.01)

(52) U.S. Cl.
CPC ..... *A41D 19/0024* (2013.01); *Y10T 24/44915* (2015.01)

(58) Field of Classification Search
CPC ..... A41D 19/0024; A41D 19/0041; A41D 19/0044; A41D 19/0048; A41D 19/0089; A41D 19/0093; A41F 17/02; A44B 99/00; A44B 6/00; D06F 55/00; D06F 55/02; Y10T 24/44915; Y10T 24/22; Y10T 24/1997; Y10T 24/44932
See application file for complete search history.

(56) References Cited

U.S. PATENT DOCUMENTS

| | | | | | |
|---|---|---|---|---|---|
| 719,462 | A * | 2/1903 | Gysling | B29C 65/02 | 24/72.1 |
| 2,107,516 | A * | 2/1938 | Bishop | A41F 17/02 | 24/72.1 |
| 2,378,747 | A * | 6/1945 | Berman | A45D 8/14 | 24/111 |
| 2,861,309 | A * | 11/1958 | Saviolides | B42F 1/02 | 24/457 |
| 4,773,132 | A * | 9/1988 | Eckels | A47G 21/10 | 24/562 |
| 6,253,385 | B1 * | 7/2001 | Fields | A44C 1/00 | 2/244 |
| D716,181 | S * | 10/2014 | McAdams | D11/202 | |
| 11,839,250 | B2 * | 12/2023 | Sanchez | G01N 21/81 | |
| 12,098,499 | B2 * | 9/2024 | Burkhart | D06F 95/008 | |
| 2008/0289159 | A1 * | 11/2008 | Solich | D06F 55/00 | 24/571 |

* cited by examiner

*Primary Examiner* — F Griffin Hall

(57) ABSTRACT

The hand gloves fold prevention clip, as the name suggests it is used to prevent the sleeves of the hand gloves from rolling back. Whenever a person puts on work gloves, their wrist sleeve rolls inward of the palm. When this happens often the sleeve pulls the hair on the wrist of the user. While rolled up sleeves cause discomfort to the user, pulling hair causes pain as well. The hand gloves fold prevention clip is plugged to the sleeve, two on each sleeve. Thus providing a comfortable fit of hand gloves without the need of the user to undo the roll/fold of the sleeve.

7 Claims, 3 Drawing Sheets

HAND GLOVES FOLD PREVENTION CLIP

CROSS-REFERENCE TO RELATED APPLICATIONS

This application takes the benefit of provisional application No. 63/532,133 filed on Aug. 11, 2023.

BACKGROUND OF THE INVENTION (1) Field of Invention: This invention is related to work hand gloves. To be more specific this invention pertains to a clip that can be plugged to a work hand gloves pair, two clips on each hand glove, in order to prevent hand gloves sleeve to roll inward on the wrist of the hand, while the user wears them.

BRIEF SUMMARY OF THE INVENTION

In an embodiment composite structure is a hand gloves prevention clip that can be plugged to hand gloves to prevent the wrist part of the hand gloves from rolling into the hand gloves which the user is wearing. Hand gloves fold prevention clip while preventing the wrist part of the gloves from rolling, also prevents the wrist part of the hand gloves to pull hair of the user in the wrist part which could cause discomfort.

In another embodiment composite structure is a rib formed by stitching thread, layer over layer on top side wrist area of the hand gloves. Two ribs are stitched on the top side in the wrist area, providing enough thickness to prevent the hand gloves wrist sleeve from folding into itself while the user wears the hand gloves.

BRIEF DESCRIPTION OF THE SEVERAL VIEWS OF THE DRAWING(S)

DETAILED DESCRIPTION OF THE INVENTION

The invention will be primarily described within the context of embodiment; however, those skilled in art and informed by the teaching, will realize that the invention is also applicable to other technical areas and/or embodiments. Practitioners skilled in the art will recognize numerous other embodiments as well.

The illustrative embodiments described herein are not meant to be limiting, it may be readily understood that certain aspects of the disclosed embodiments can be arranged and combined in a variety of different configurations, all of which are contemplated herein.

Figure 1:
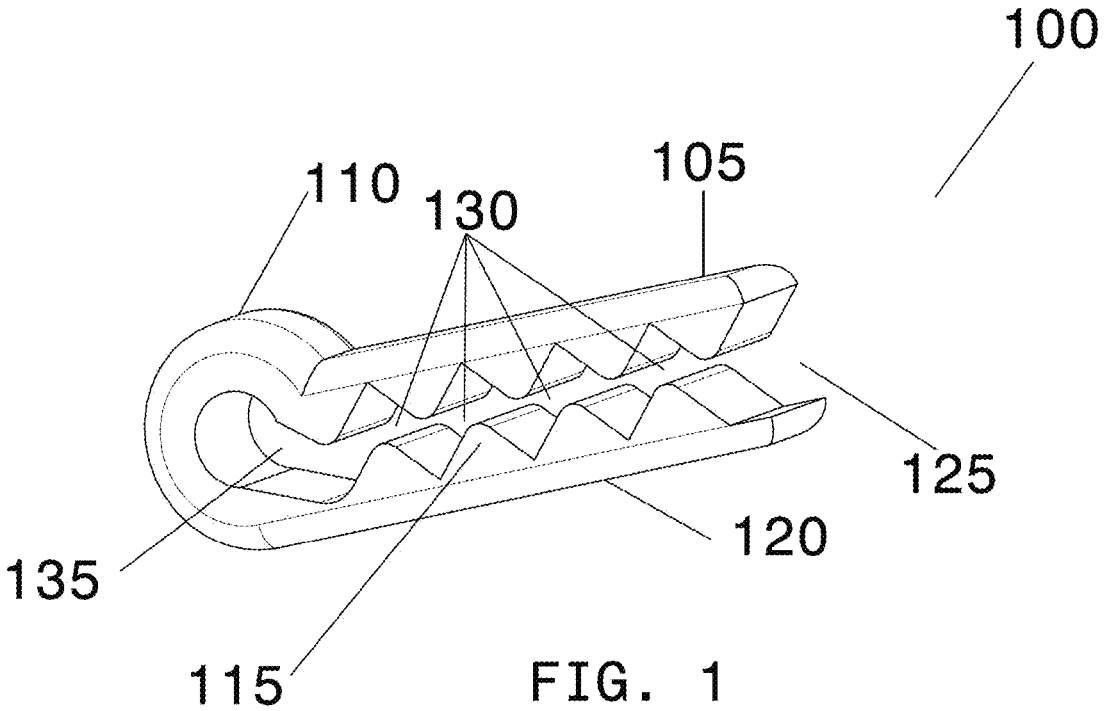
FIG. 1 shows an illustrative isometric view of hand gloves fold prevention clip the present invention.

FIG. 1 depicted an isometric view of an exemplary composite structure of hand gloves fold prevention clip 100 according to an embodiment. The hand gloves fold prevention clip 100 is preferably a single part that consists of 7 major features of (1) upper tentacle 105, (2) cul-de-sac 110, (3) sawtooth 115, (4) lower tentacle 120, (5) open mouth 125, (6) gap 130, (7) angled gap 135. As described above, composite structure 100 serves as a hand gloves prevention clip when plugged to the wrist sleeve of the work hand gloves. The upper tentacle 105 and lower tentacle 120 which run in straight finite parallel lines, has a cul-de-sac 110 on one end and an open mouth 125 on the other. Also, the hand gloves fold prevention clip 100 has sawtooth 115 which will help the hand gloves fold prevention clip 100 to hold on the hand gloves.

Figure 2A:
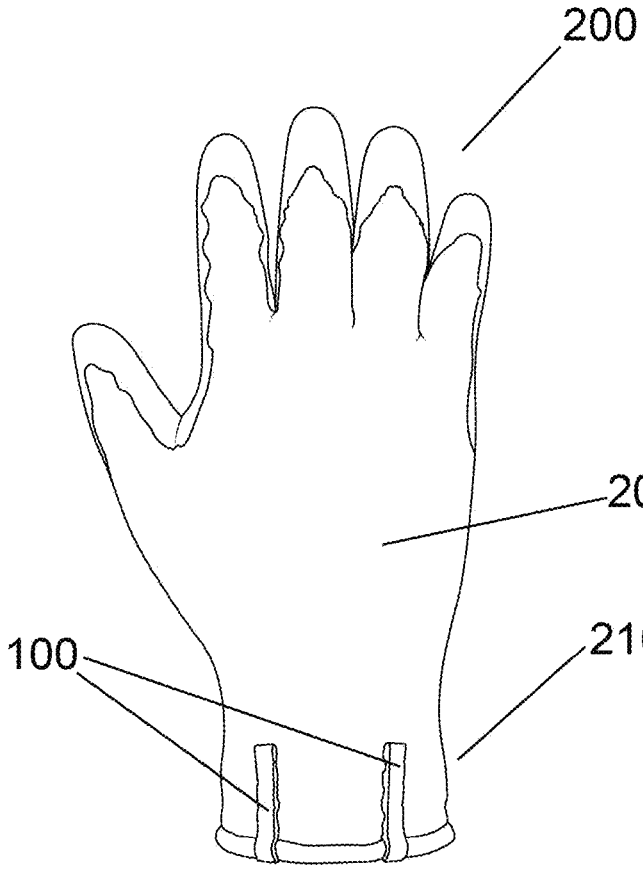
FIG. 2A shows an illustrative top view of hand gloves with hand gloves prevention clip the present invention in use.

FIG. 2A depicted a top view of an exemplary composite structure of hand gloves fold prevention clip 100 plugged to hand gloves. The composite structure preferably consists of 4 major components (1) hand gloves and clip assembly 200, (2) hand gloves 205, (3) hand gloves fold prevention clip 100, (4) wrist sleeve 210 of the hand gloves 205. When the hand gloves fold prevention clip 100 is plugged to hand gloves 205 it prevents the wrist sleeve 210 of the hand gloves 205 from rolling into itself.

Figure 2B:
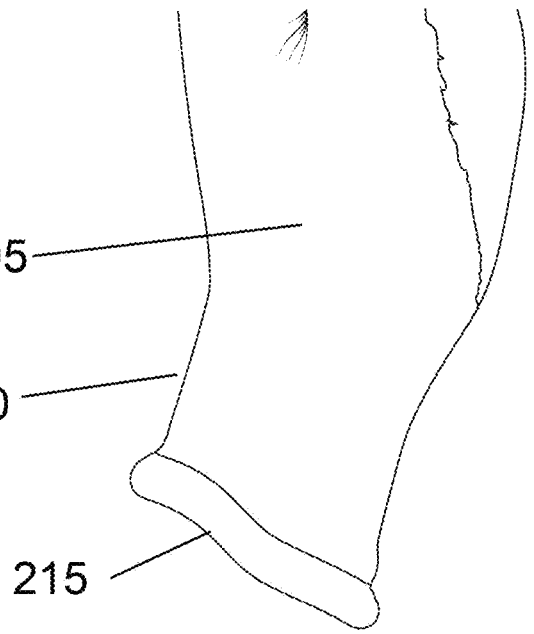
FIG. 2B shows an illustrative side view of the hand gloves with the inward folded wrist of the hand gloves.

FIG. 2B depicts a side view of the hand gloves 205 and its wrist sleeve 210's, perimeter portion 215 that is folded inward after the user wears it to the palm without hand gloves fold prevention clip 100.

Figure 3A:
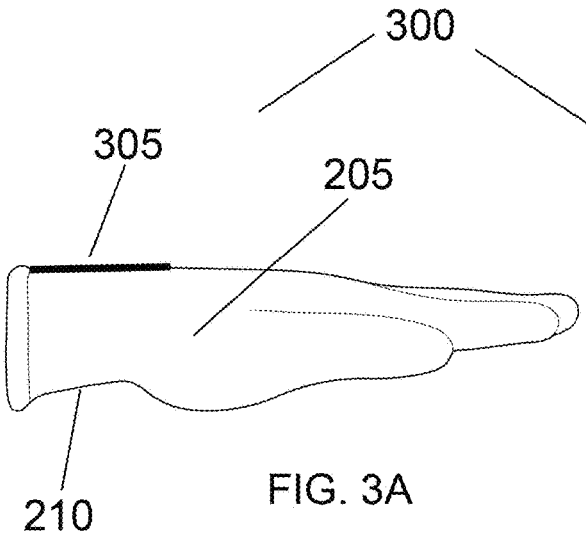
FIG. 3A shows an illustrative side view of the hand gloves with the stitched rib on the top in the wrist area, the present invention in use.

FIG. 3A depicts a side view of the composite structure of hand gloves with ribs on the user's hand. The composite structure typically consists of 3 major components (1) hand gloves 205, (2) rib 305, and (3) hand gloves with stitched rib 300. The rib 305 is just a thread stitched to the top side of hand gloves wrist sleeve 210, layer over layer until a substantial thickness of rib appears that is strong enough to prevent the hand gloves wrist area to fold inward when the user wears the hand gloves.

Figure 3B:
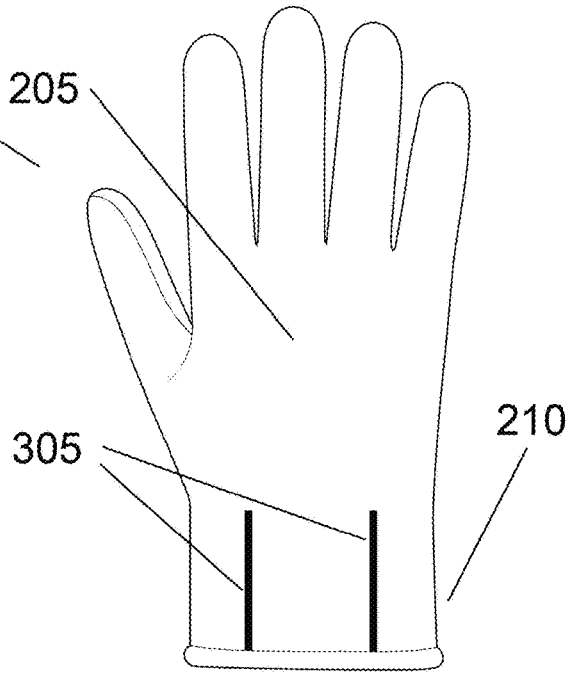
FIG. 3B shows an illustrative top view of the hand gloves with the stitched ribs on the top in the wrist area, the present invention in use.

FIG. 3B depicts a top view of the composite structure of hand gloves with rib 305. This rib 305 provides enough strength to prevent the hand gloves from folding inward.

The invention claimed is:

1. A hand gloves fold prevention clip comprising:

a pair of tentacles including an upper tentacle and a lower tentacle, the upper tentacle being disposed above the lower tentacle, the tentacles being straight and parallel to each other in an at-rest state, the tentacles each including a proximal end connecting to a cul-de-sac of the clip and an opposite distal end at an open mouth of the clip, the tentacles being spaced apart to define a gap therebetween in the at-rest state, each tentacle having smoothed or rounded outer side edges extending along a length of the tentacle from the cul-de-sac to the open mouth;

each tentacle including a sawtooth section on an inside surface facing the gap, each sawtooth section extending from adjacent the cul-de-sac along the gap to the adjacent the open mouth, wherein the sawtooth section extends generally in a direction along the length of the respective tentacle and across an entire width of the tentacle between the outer side edges of the tentacle;

wherein the cul-de-sac forms a generally circular shape having a hollow interior, wherein a lower exterior surface of the cul-de-sac is flush with a lower exterior surface of the lower tentacle at the proximal end of the lower tentacle and wherein an upper exterior surface of the cul-de-sac is raised relative to an upper exterior surface of the upper tentacle at the proximal end of the upper tentacle, wherein the lower exterior surface of the lower tentacle and the upper exterior surface of the upper tentacle are both flat, planar surfaces;

wherein hollow interior of the cul-de-sac is connected to the gap by an angled gap, wherein the angled gap extends at a non-orthogonal angle between the hollow interior and the gap;

wherein the clip is configured to be plugged onto a wrist sleeve of a hand glove such that the wrist sleeve is received in the gap between the tentacles, wherein the clip is configured to prevent the wrist sleeve from rolling inward toward a fingertip end of the hand glove while a user is wearing the hand glove with the clip plugged to the wrist sleeve.

2. The clip of claim 1, wherein a distal tip of the distal end of the lower tentacle includes a flange extending beyond a distalmost edge of the sawtooth section of the lower tentacle and a distalmost edge of the sawtooth section on the upper tentacle extends to a distal tip of the distal end of the upper tentacle.

3. The clip of claim 1, wherein the clip includes an opening extending continuously from the open mouth to the hollow interior of the cul-de-sac.

4. The clip of claim 3, wherein the opening includes the gap, the angled gap, and the hollow interior.

5. The clip of claim 1, wherein when the clip is plugged to the wrist sleeve of the hand glove, a perimeter portion of the wrist sleeve is configured to be received in the gap adjacent the cul-de-sac such that the perimeter portion lies between the tentacles and against the cul-de-sac while being held in place by the sawtooth sections.

6. The clip of claim 1, wherein the clip is configured to prevent the wrist sleeve from folding around itself toward the fingertip end of the hand glove and to prevent the wrist sleeve from pulling hairs on a wrist of the user while the user is wearing the hand glove with the clip plugged to the wrist sleeve.

7. The clip of claim 1, wherein when the wrist sleeve is received within the gap between the tentacles and extends along the sawtooth sections and along the angled gap toward the cul-de-sac, a perimeter portion of the wrist sleeve is guided along the gap toward the cul-de-sac and held between the tentacles by the sawtooth sections while the user is wearing the hand glove and the clip.

* * * * *